US008001890B2

(12) United States Patent
Endres et al.

(10) Patent No.: US 8,001,890 B2
(45) Date of Patent: Aug. 23, 2011

(54) COLOR-GRADIENT PRINTING SYSTEM

(75) Inventors: Rainer Endres, Karsbach (DE); Peter Schmitt, Wuerzburg (DE)

(73) Assignee: KBA-Metronic AG, Veitshochheim (DE)

( * ) Notice: Subject to any disclaimer, the term of this patent is extended or adjusted under 35 U.S.C. 154(b) by 514 days.

(21) Appl. No.: 12/255,094

(22) Filed: Oct. 21, 2008

(65) Prior Publication Data

US 2009/0260529 A1 Oct. 22, 2009

(30) Foreign Application Priority Data

Oct. 25, 2007 (DE) ..... 10 2007 051 434

(51) Int. Cl.
*B41F 31/03* (2006.01)

(52) U.S. Cl. ..... 101/205; 101/210; 101/DIG. 34; 101/364

(58) Field of Classification Search ..... 101/207, 101/208, 206, 210, 205, 202, 204, 204.1, 101/364, 350.1, 352.13, 349.1, 348, DIG. 34
See application file for complete search history.

(56) References Cited

U.S. PATENT DOCUMENTS

| | | | | | |
|---|---|---|---|---|---|
| 397,091 | A | * | 1/1889 | Mortimer | 118/222 |
| 2,154,544 | A | * | 4/1939 | Auburn | 101/350.3 |
| 2,655,752 | A | * | 10/1953 | Smejda | 106/316 |
| 2,887,044 | A | * | 5/1959 | Smejda | 101/115 |
| 5,161,462 | A | * | 11/1992 | Okamura et al. | 101/207 |
| 5,189,956 | A | * | 3/1993 | Reder et al. | 101/364 |
| 5,979,319 | A | * | 11/1999 | Hamaoka et al. | 101/350.1 |

* cited by examiner

*Primary Examiner* — Judy Nguyen
*Assistant Examiner* — Leo T Hinze
(74) *Attorney, Agent, or Firm* — Andrew Wilford

(57) ABSTRACT

An inker for applying ink to a transfer roll of a printing machine has an inking chamber extending longitudinally along the transfer roll and having an outlet also extending longitudinally along the transfer roll and open against the transfer roll and a first generally cylindrical mixing chamber centered on an axis, spaced transversely from and extending longitudinally along the transfer roll. A rotatable shaft extending along the axis in the mixing chamber carries a partition subdividing the mixing chamber into two axially adjacent and axially spaced mixing compartments open radially into the inking chamber. At least two inlet conduits open onto each of the compartments, and a pump feeds respective inks to the inlet conduits and therethrough into the mixing compartments.

16 Claims, 6 Drawing Sheets

COLOR-GRADIENT PRINTING SYSTEM

FIELD OF THE INVENTION

The present invention relates to color-gradient printing system. More particularly this invention concerns an ink applicator for a color-gradient printing apparatus and method.

BACKGROUND OF THE INVENTION

In color-gradient printing an applicator applies printing ink to an ink-transfer roll and has an ink supply with an outlet slot extending the full width of the ink supply and from which ink is emitted and applied to an ink-transfer roll. The ink is applied to the ink-transfer roll so as to produce color-gradient printing using at least two different printing inks.

This type of ink supply typically has a narrow side and a wide side, the wide side extending along and parallel to the rotational axis of the ink-transfer roll. The outlet is delimited by two narrow end walls of the ink supply and a long downstream doctor blade and a long upstream doctor blade that both contact the rotating ink-transfer roll. As a result, the outlet is closed by the outer surface of the ink-transfer roll where, due to the rotation of the ink-transfer roll, the printing ink in the ink supply forms a counter-rolling ink mass or bank from which printing ink passes to depressions in the ink-transfer roll and is transferred onto another roll, e.g. another ink-transfer roll or a roller carrying a printing plate.

An approach for generating color-gradient printing using these ink supplies has been known for some time, e.g. as a security feature. Here, for example, at least two different printing inks in a printing unit are applied side-by-side to the outer surface of an ink-transfer roll such that the printing inks touch or overlap, at least at their borders, and the printing inks mix together on the ink-transfer roll by means of suitable additional distributing rollers acting on the outer surface of the ink-transfer roll.

As a result, continuous color gradients are created at the border overlap regions of the adjacent printing inks, which gradients can be transferred, for example, by a printing plate onto a substrate. The motifs thus printed then have a corresponding color gradient with continuous color transitions since in this case a genuine mixing together of printing inks occurs.

Depending on the implementation of the ink supplies employed, it is also possible to use multiple different printing inks, thereby enabling the system to effect, for example, a rainbow-like color gradient. In this case, one ink supply of the known type has, for example, multiple side-by-side compartments holding different printing inks that are separated from each other by partitions. The regions here each have an outlet directed toward an ink-transfer roll, the respective printing ink being transferred to a specific portion of the ink-transfer roll.

It may be advantageous here to provide a common doctor blade for all the side-by-side ink supplies, thereby enabling a homogeneous application of ink over the entire outer surface of the ink-transfer roll to be achieved. In addition, it is possible for a mixing zone to be created, at least immediately at the edges of the doctor blades inside the ink supply at the borders of adjacent areas, thereby enabling a first continuous mixing together of different adjacent printing inks to be effected.

The further mixing together or distribution of the printing inks applied to the ink-transfer roll is subsequently effected by one or more distributing rollers that act on the surface of the ink-transfer roll and, for example, thus mixing together the printing inks at varying rotational speeds and/or using supplemental axial movements of the rollers.

However, a disadvantageous aspect here is that when using ink supplies of the known type a color gradient can be generated essentially only in one direction of the ink-transfer roll. Another disadvantage is that when using multiple printing inks in a common ink supply essentially only adjacent inks can be mixed together, with the result that a variable mixing of inks, and, in particular, a selective variable mixing of ink during operation is impossible.

Specifically, if, for example, three different process-printing inks—cyan, magenta and yellow—are disposed side-by-side in the referenced sequence in the referenced ink supply, the adjacent printing inks cyan and magenta, or magenta and yellow, can be mixed together on an ink roller—not however, the cyan and yellow printing inks. In addition, specially fitted ink supplies with partitions must be employed, with the result that existing printing units cannot be readily retrofitted.

Since the mixing together of inks increases continuously in this type of printing, and thus the mixing zone between the different printing inks on the printing roller is continually widened, while additionally already-mixed inks pass via the known back-transport of printing ink from the rolling ink mass into the ink supplies, the printing roller and ink supplies must be cleaned continuously, or at least at regular intervals, a process that can result in a not insignificant loss of ink in the printing machine. Color-gradient printing is therefore preferentially used in producing security papers in, for example, rotary offset printing presses or gravure printing presses.

An additional disadvantage of the known described type of color-gradient printing is that a series of additional components are required inside the printing unit—such as distributing rollers, cleaning devices, and their corresponding drive units and control system—due to the desired and requisite distribution of printing inks on the printing roller and to the continuously required cleaning of the printing roller, by which means a stable printing operation can be ensured. This increases the complexity of the printing unit and thus encumbers its operability, but also requires additional space for the requisite ancillary components, which factors, for example, impede or make it impossible to retrofit an existing printing machine with a color-gradient printing unit.

It is impossible to reproduce these types of continuous color transitions with the known printing techniques such as, for example, offset printing, flexographic printing, or even gravure printing, since these other techniques use a subtractive superimposition of multiple color separations of a printed image printed in succession on a substrate to reproduce a certain color impression, which aspect becomes clearly visible at least when an image thus printed is enlarged. What results from these techniques is thus an overlay—not mixing—of multiple colors.

OBJECTS OF THE INVENTION

It is therefore an object of the present invention to provide an improved color-gradient printing system.

Another object is the provision of such an improved color-gradient printing system that overcomes the above-given disadvantages, in particular that avoids the above-mentioned disadvantages and provides selectively modifiable color-gradient printing, while additionally limiting the loss of ink.

Another object of the invention is to provide the ability to retrofit an existing printing unit for color-gradient printing.

Yet another object is to provide an improved method of operating a printing machine for color-gradient printing.

SUMMARY OF THE INVENTION

An inker for applying ink to a transfer roll of a printing machine has according to the invention an inking chamber extending longitudinally along the transfer roll and having an outlet also extending longitudinally along the transfer roll and open against the transfer roll and a first generally cylindrical mixing chamber centered on an axis, spaced transversely from and extending longitudinally along the transfer roll. A rotatable shaft extending along the axis in the mixing chamber carries a partition subdividing the mixing chamber into at least two axially adjacent and axially spaced mixing compartments open radially into the inking chamber. At least two inlet conduits open onto each of the compartments, and respective pumps feed respective different inks to the inlet conduits and therethrough into the mixing compartments.

Thus the object of the invention is attained, in other words, in that the supplied printing inks are mixed together in the mixing compartments and then fed to the inking chamber for application to sectors of the transfer roll.

In this regard, the inking chamber can, using the known approach, have two doctor blades each carried on a respective one doctor plate. The outlet is formed between edges of the doctor and the ink passes between these blades from the inking chamber onto the ink-transfer roll.

The object is furthermore attained by the method of this invention wherein the axially uninterrupted and open inking chamber is filled over the entire length of its outlet with inks from a mixing chamber that are different at least locally, and the mixing chamber is partitioned into multiple mixing compartments disposed side-by-side, in particular, over the length of the outlet, in which compartments the ink from at least two different supplied inks is mixed.

An essential core idea of the invention here is not the conventional approach of the prior art whereby the different printing inks to be mixed together are applied to a common ink-transfer roll by means of side-by-side disposed ink supplies and first mixed together on the outer surface of the roll by a number of distributing rollers, but instead one in which the mixing is done in advance in a mixing chamber in which the printing inks are mixed together locally and a color gradient is formed before the printing ink enters the inking chamber, with the result that the printing ink transferred from the inking chamber onto the ink-transfer roll already contains a color gradient.

To this end, the mixing chamber is provided with at least two mixing compartments into which printing ink is supplied through at least two feed lines or inlet conduits, thereby enabling at least two different color inks to be mixed in each of the mixing compartments. It is of course possible here to load a mixing compartment with only a single ink through the at least two feed lines if no mixed color is needed.

Another essential aspect of the invention is that the inking chamber is filled with mixed printing ink from the outlets of the mixing compartments of the mixing chamber over essentially the entire length of the outlet, the mixing compartments being situated side-by-side as viewed over the length of the outlet. As a result, the relative orientations of the outlets of the individual mixing compartments defines where a specific printing ink mixture is fed in as relates to the length of the outlet of the inking chamber.

If the ink is fed in while the printing unit is operating, a rotating cylindrical rolling ink mass is created from the highly viscous ink in the inking chamber on the outer surface of the ink-transfer roll, the rolling ink mass having different colors or color gradients over its width along its cylindrical axis, at least locally, in particular—as along as additional mixing together in the inking chamber is not considered—where the regions of different printing-ink mixtures of the rolling ink mass at least essentially originate in the respective mixing compartments of the mixing chamber. A positional dependence of the printing ink mixtures as determined by the arrangement of the outlets of the mixing compartments is thus at least essentially preserved in the inking chamber.

In this regard, it is advantageous according to the invention for the device if the mixing compartments of a mixing chamber are disposed in the inking chamber side-by-side and in a side-by-side arrangement parallel to the length of the outlet. In this implementation, the positional side-by-side arrangement of the mixing compartments and their respective outlets defines the positional arrangement of the mixed colors in the developing rolling ink mass.

Fundamentally, however, it is irrelevant for the implementation of the method according to the invention what arrangement the mixing compartments have, so long as at least the outlets of the mixing compartments are situated side-by-side and parallel to the length of the outlet in this side-by-side arrangement such that the ink mixed in the respective mixing compartments obtains a positional association with the outlet width and also at least essentially retains this association during rotation in the inking chamber.

Depending on the number of mixing compartments used here, and/or different printing inks, multiple color gradients can appear along the above-mentioned cylinder axis of the rolling ink mass. The ink distribution present in the rotating printing rolling ink mass in the inking chamber will then be transferred directly onto the ink-transfer roll.

For operating the device according to the invention, provision can be made whereby the inker has multiple independently controllable ink supply devices, wherein the ink supply devices can, for example, each be connected to a different ink storage reservoir, and in particular, wherein the respective ink supply volume thereof is adjustable. In particular, mutually independent selective printing inks, in particular, different printing inks can be transported by the ink supply devices into the mixing chamber and mixed together there.

One mixing chamber here can have a separate outlet for each mixing compartment, or even a common ink outlet in another embodiment, which outlet extends parallel to the outlet or the length of the outlet of the inking chamber and is impinged upon by the mixed printing ink from all outlets of the mixing compartments.

This has the particular advantage that ink can be delivered from the mixing chamber to the rolling ink mass of the inking chamber by an ink curtain of at least locally different mixed ink, the curtain flowing between the mixing chamber and the inking chamber, and extending over the entire width of the rolling ink mass in the axially throughgoing and uninterrupted inking chamber.

In addition, the mixing chamber can also have an ink outlet that extends parallel to the outlet of the inking chamber and into which all ink feed lines discharge, the printing inks discharging at least locally from the ink outlet into different mixing compartments.

According to the invention, provision can be made whereby the mixing chamber has its outlet on a side opposite the inlets connected to the respective the ink-supply devices, through which outlet the mixed together printing inks pass into the inking chamber and thus onto the surface of the ink-transfer roll.

The ink feed lines of the mixing compartments here can have different cross-sectional profiles, at least in the region of their outlet ends, preferably over their entire length. In a parallel arrangement, the ink feed lines can also discharge side-by-side into the mixing compartments, their respective outlet ends being side-by-side in an arrangement parallel to the outlet of the inking chamber, or essentially along a line parallel to the axis of the ink-transfer roll.

Provision can be made whereby the outlet ends of the ink feed lines are slits with a given width, in particular, at a height that changes over its width, thereby enabling, for example, a conical or triangular or tapered cross-sectional shape to be produced, or even a rhomboidal shape or a lenticular shape. Depending on requirements, any other desired shapes can also be selected for the outlet ends.

The outlet ends of the respective ink feed lines can be disposed side-by-side in such a way that they overlap parallel to the axis of the ink-transfer roll. What can be produced thereby is a slit arrangement of a certain overall length that, for example, can be comprised within a corresponding bracket.

Provision can be made whereby the sum of all slit heights remains constant along the entire direction of extent, this aspect ensuring that given an identical ink supply rate determined for all ink supply devices the slit arrangement is able to deliver the identical total ink volume at each location of the arrangement's total length.

It is also possible for the outlet ends of the ink feed lines at least partially to overlap or to enclose each other, in particular, in such a way that within the region of the overlap or enclosure the sum of the heights of two overlapping outlets is identical throughout. The overlap/enclosure can also be present in terms of all of the ink feed lines, that is, at least locally over the longitudinal extent of the supply channels. Due to this overlap, it is also possible for initial corresponding ink mixing zones to form already during the ink supply. The outlet end of a feed line can also supply two adjacent mixing compartments of a mixing chamber with the same ink. All of the features of the feed lines can also be implemented alone or in any desired combination.

Provision can furthermore be made according to the invention whereby the outlets of the different ink feed lines are disposed back-to-back as viewed in the rotational direction of the ink-transfer roll, in particular, if the mixing chamber is designed so as to be cylindrical and parallel to the rotational axis of the ink-transfer roll or of the outlet of the inking chamber. In this design, the feed lines can discharge at different angles into the mixing chamber and its compartments.

Provision can furthermore be made according to the invention whereby the ink supply devices comprising the ink feed lines are attached, either individually or in groups, to support, wherein that are optionally movable either synchronously or asynchronously to the rotational motion of an ink-transfer roll, in particular, along a direction of motion lying parallel to one axis of the ink-transfer roll.

In one embodiment, multiple mixing chambers can also be disposed between the above-mentioned ink supply devices with the ink feed lines, in which chambers the different printing inks from the ink supply devices are mixed together and which chambers supply the mixed together printing inks for transfer onto the ink-transfer roll.

At least one additional mixing chamber, in particular of identical type, can thus be connected upstream from the mixing chamber, and each ink feed line from a mixing compartment of a successive mixing chamber can be connected to at least one other mixing compartment of a previous mixing chamber.

As a result, the inks to be mixed can be delivered from at least one of the upstream mixing chambers to the next downstream mixing chamber, for which purpose in one embodiment multiple mixing chambers can be disposed in series, in particular, the inks to be mixed being supplied to one mixing compartment of a mixing chamber from at least two mixing compartments of an upstream mixing chamber. To this end, the mixing compartments of two successive mixing chambers can be staggered relative to each other such that one outlet slot of a mixing compartment of an upstream mixing chamber discharges into at least two mixing compartments of a following mixing chamber.

Overall, provision can be made whereby the volume of ink transported through the mixing compartments of a mixing chamber, e.g. by pumps of the supply devices, is identical for all mixing compartments, in particular such that the inks to be mixed are delivered in different proportions to a mixing compartment of a mixing chamber. In the implementation of the method, the different proportions can be modified, e.g. by a higher-level control means, and in particular thus adjusted to requirements.

Mixing together of the different delivered printing inks in the mixing compartments can fundamentally occur by any means, whether passive, e.g. by means of rigid or permanently-disposed flow elements, or also by active measures. For example, provision can be made whereby mixing together of the inks is effected in one mixing compartment by mixing bodies that are moved in one mixing compartment by a common rotated shaft that passes through the mixing compartments. For example, loose mixing bodies, in particular, balls can be disposed in the mixing compartments that are moved by stirrers on the shaft or partitions integrated into the shaft. In particular these mixing bodies effect an averaged directional motion in the direction of motion of the shaft. More particularly the balls of a mixing compartment remain in this compartment even when they are moving. The mixing bodies or balls here can be composed of an abrasion-resistant and/or chemically inert material.

A mixing chamber can thus be implemented at least locally as a so-called ball mill, or also at least locally have distributing rollers. In these embodiments, provision can be made whereby a mixing chamber is designed as cylindrical, wherein the partitions can be attached on a commonly-driven and rotating central shaft, and the mixing compartments are each preferably filled with mixing elements. The synchronously rotated partitions and shaft here can have stirrers for the mixing elements.

As long as the mixing compartments are not separated from each other by ink-impervious partitions, a mixing together of the inks of adjacent mixing compartments can also be effected between the mixing compartments through the ink-permeable partitions.

The outer surface of the cylinder of the mixing chamber can in particular be slitted on two sides and the slits can each form one inlet and one outlet slot. The mixing chamber here is subdivided along its axis into a predetermined number of mutually separated mixing compartments that are each connected to the outlets of the ink feed line only through a certain region of the inlet, and through which the respective mixing compartments are each filled only with a predetermined proportion of a given printing ink.

The respective proportions of ink that have penetrated through the inlet of the mixing chamber into the respective mixing compartments pass between the balls and are mixed together due to the above-mentioned irregular motions of the balls, thereby producing the respective homogeneous mixed colors. The fact that the balls are significantly impeded in their motion along the cylinder axis by remaining in their given mixing compartment, and are also separated from each other, for example, by partitions, prevents any undesired carry-over of ink along the cylinder axis of the mixing chamber. In addition, the mixed ink is transported more or less in a straight line through the mixing chamber, with the result that due to the short residence time of the mixed ink in the mixing chamber no impermissible or undesired mixing together of adjacent sections occurs.

When using a relatively small number of mixing compartments in a mixing chamber, it can be advantageous to dispose a second mixing chamber, or possibly multiple mixing chambers of the same type back-to-back so that the mixed ink from the upstream mixing chambers is delivered to the downstream mixing chambers, in particular, as already described above. One mixing compartment here of a following mixing chamber can be supplied with mixed inks from two mixing compartments of a previous mixing chamber, in particular, for which purpose the inlets of the following mixing chambers can in each case be disposed in staggered fashion relative to the outlet slots of the previous mixing chamber.

This feature enables any color difference of adjacent second mixed colors that are still present at the outlet slot of the first mixing chamber to be further equalized, due to the fact that, for example, in each case half proportions of adjacent second mixed colors of the first mixing chamber pass into a following mixing compartment of a second mixing chamber and are mixed together there in the manner described, with the result one mixed color each ready for a printing run emerges at the last outlet slots of the last mixing chamber.

Provision can furthermore be made whereby the following mixing chambers have an identical or different number of mixing compartments in order to generate the desired color gradient.

Provision can furthermore be made whereby the respective mixing compartments of a mixing chamber are each of a different width in order to generate the desired color gradient.

The prepared mixed ink thus generated subsequently passes into the inking chamber which acts directly on the outer surface of an ink-transfer roll, for example, an anilox roll, and is closed relative to this roll by corresponding doctor blades positioned on the outer surface parallel to the roll axis. This ensures that no printing ink emerges in uncontrolled fashion and provides a defined ink transfer onto the ink-transfer roll.

Provision can also be made here whereby the last mixing chamber is designed such that the doctor blades constitute at least one part of the mixing chamber.

Provision can furthermore be made whereby the rotational direction of the prepared mixed ink transferred to the mixed ink due to the motion of the ink-transfer roll and applied to the outer surface of the ink-transfer roll is effected in the same direction or opposite direction relative to a rotational direction of the mixing device effected on the prepared mixed ink in the last mixing chamber.

In another embodiment, provision can be made whereby multiple slit arrangements are disposed back-to-back as viewed in the direction of production that have the same or a different number of ink supply devices, and their respective outlets act on a common mixing chamber, which approach provides the ability to modify or adjust a desired color gradient during operation by, for example, selectively turning on or off the corresponding printing inks from the corresponding ink supply devices in one of the slit arrangements, or by appropriately adjusting the ink volumes of these devices.

In all embodiments, provision can be made whereby the diameter of the rolling ink mass formed during operation on the outer surface of the ink-transfer roll in the inking chamber is determined by sensors in the specific area of the outlets of the ink supply devices and/or in the area of the mixing device, in particular, is determined at different positions and is readjusted through the respective ink supply devices by means of an appropriate control means.

Provision can furthermore be made whereby the respective ink supply rates from the respective ink supply devices are designed to be controllable by an approach, for example, wherein the given supply rate of the devices is adjustable by controllable pumps or valves. As is explained in more detail below, this provides the ability to affect the width of the color-gradient zones.

If, for example, all of the ink supply devices are adjusted such that the same supply rate emerges from the respective outlets of the ink feed lines, in each case a locally different ink volume will emerge based on the local slit heights of the overlapping outlets. If the outlets, for example, have a rhomboidal cross-section, the respective supply rates along the slit will have an essentially triangular distribution. In the overlap region of adjacent outlets, two different printing inks each will thus move together, where their proportions in percent will depend on the position along the slit arrangement and will range from 0%:100%, through 50%:50%, to 100%:0%.

What thus occurs at this position is an initial mixing together of adjacent printing inks, where at this point in time the printing inks still lie essentially separated next to each other.

As a result, according to the invention this mixed ink passes into a mixing device according to the invention, which mixing device immediately follows the slit arrangement and is described above, in which mixing device this mixed ink is mixed together such that, first of all, a homogeneous ink mixture is set, and secondly, the mixing together of this mixed ink in each case remains locally limited, thereby preventing a complete mixing together of adjacent areas of the mixed ink and an associated destruction of a color gradient.

To this end, as mentioned, the mixing chamber can be made for example, essentially as a ball mill, the mixing chamber having an inlet receiving the mixed ink and an outlet slot situated, for example, opposite the inlet through which the mixed ink emerges.

Provision can be made here whereby the mixed ink has only a short residence time in the mixing chamber and is transported more or less in a straight line through the mixing chamber, thereby preventing any excessive or undesired mixing together of adjacent areas of the mixed ink.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
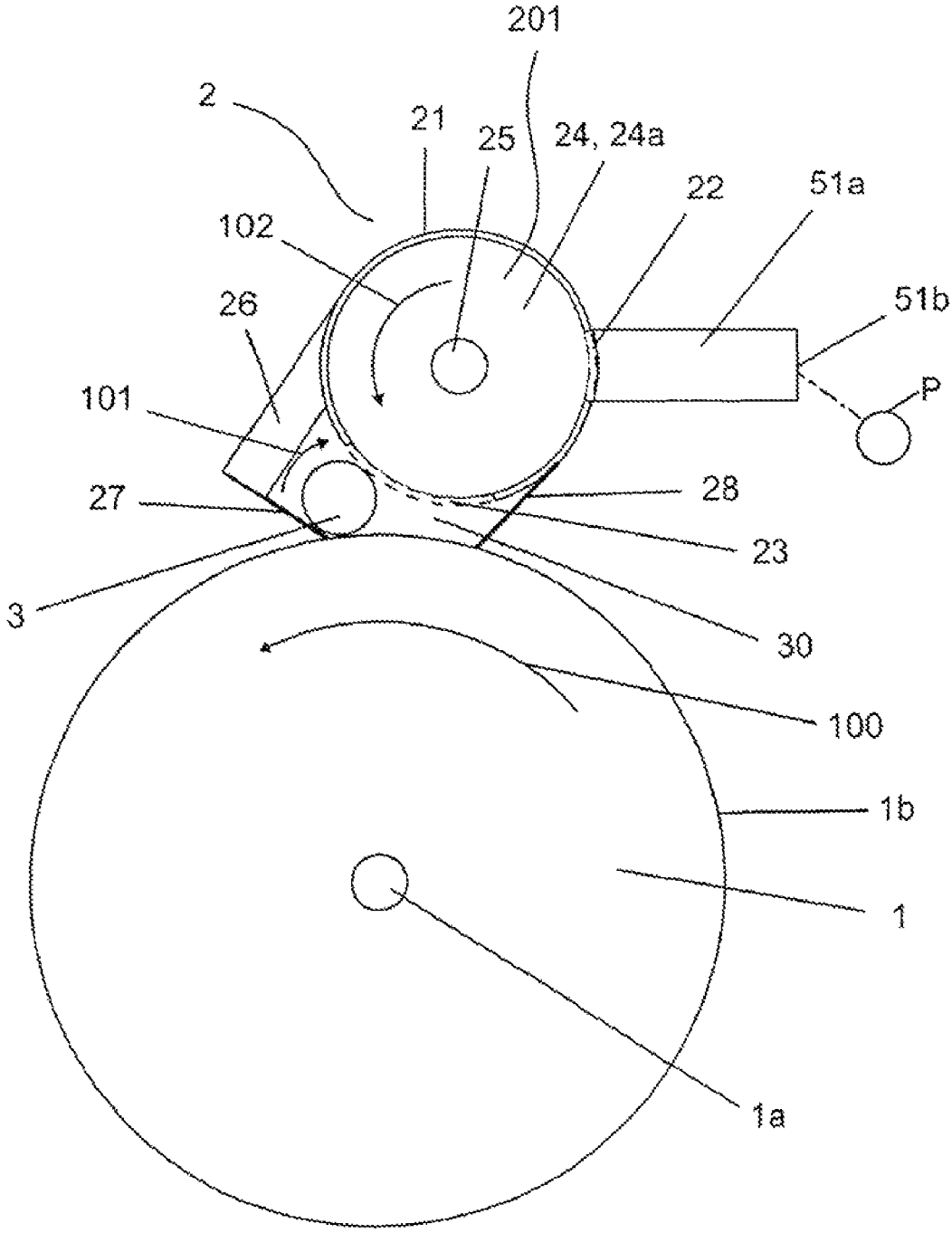
FIG. 1 is a schematic end view of a first embodiment of an inker according to the invention.
Figure 2:
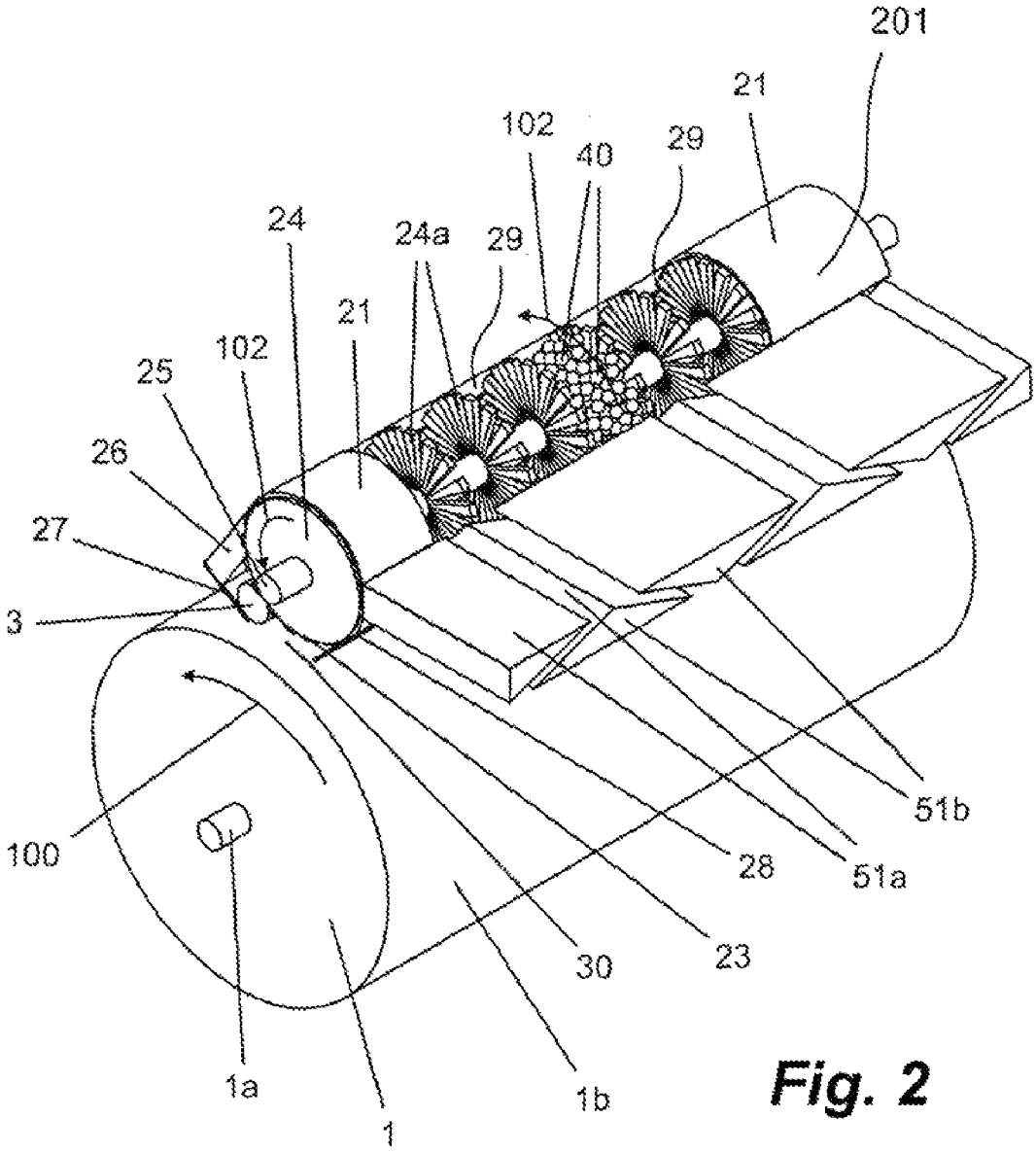
FIG. 2 is a schematic perspective view of an inker as shown in FIG. 1.

As seen in FIGS. 1 and 2 a first embodiment of an inker 2 according to the invention for mixing together different printing inks to generate color gradients is generally cylindrical and has an inlet opening 22 on one side of its cylindrical outer surface 21 through which the different printing inks pass through respective feed passages 51*a* into the interior of a mixing chamber 201. In order to show the interior of inker 21, in FIG. 2 part of the outer surface 21 has been removed; in practice the chamber 201 is closed except at the angularly offset outlet slot 23 and inlet slot 22 that both extend substantially a full axial length of the inker 2.

The inker 2 has an outlet opening 23 on its side facing an ink-transfer roll 1, through which outlet 23 the prepared mixed ink passes onto an outer surface 1*b* of the ink-transfer roll 1. In order to transfer a constant volume of ink onto the outer surface 1*b* of the ink-transfer roll 1, which is essentially independent of the rotation rate of the ink-transfer roll rotating about its axis 1*a*, the ink-transfer roll 1 is designed, for example, as an anilox roll that has a predetermined ink acceptance volume as a function of the number and formation of cells on its surface.

The inker 2 furthermore has a downstream doctor 27 and an upstream doctor 28, as well as end plates or covers 24 that axially delimit a inking chamber 30 formed between the inker 2 and the ink-transfer roll 1 so that printing ink is prevented from escaping in uncontrolled fashion from the inking chamber 30 or from the inker.

Rotation of the ink-transfer roll 1 in a direction 100 about the roll axis 1*a* creates a rolling body 3 of ink which rotates in a direction 101 opposite the rotational direction 100 of the ink-transfer roll 1 and from which the printing ink is transferred onto an outer surface 1*b* of the ink-transfer roll 1. In creating the rolling ink mass 3, it can be advantageous to attach the downstream doctor 27 to the side wall 26 at spacing outward from the edge of the doctor 27 engaging the surface 1*b* so that a corresponding space can be formed for the inking chamber 30.

The downstream doctor 27 here wipes excess printing ink off the surface 1*b* of the ink transfer or anilox roll 1. The upstream doctor 28 seals the inking chamber 30 on the side of the inking chamber 30 opposite the doctor 27 so that no printing ink can leak out of inking chamber 30, for example, when the printing machine is not running, when no rolling ink mass 3 is created and the inking chamber 30 is more or less filled with printing ink.

According to the invention, the inker 2 has the inlet 22 through which the different printing inks pass, for example, from respective feed conduits 51*a* into the interior of inker 2 that forms the mixing chamber 201. The printing inks here can be fed by pumps P from storage reservoirs into the inker 2. Upstream inlet ends 51*b* of the feed conduits 51*a* here can have different heights over their widths (along the axial extent of the mixing chamber), as shown in FIG. 2, so that they are triangular cross section as shown for example in FIG. 2. The inlet ends 51*b* are furthermore disposed such that they overlap at their also triangular outlet ends at the chamber inlet 22, thereby creating an identical outlet cross-section (in particular, per unit of length) formed in total from the respective adjacent inlet ends 51*b* over the entire inlet end 22. This is done by overlapping the triangular conduits 51*a* in alternate orientations, that is one pointing up and the next pointing down as clearly shown in FIG. 2.

The interior of the inker 2 is subdivided longitudinally into an axially extending row of mixing compartments 29 that are separated by circular partitions 24*a*, and the inking chamber is closed to the outside by the end plates 24. The partitions 24*a* are, for example, mounted on a common rotatable shaft 25 defining the center axis of the cylindrical chamber 201 and attached such that they are also rotationally entrained when the shaft 25 rotates. Provision is furthermore made whereby the respective mixing compartments 29 each have a plurality of loose balls 40 that are set into motion, in response to rotation of shaft 25 in direction 102, for example, by stirrers (25*a* in FIG. 3) that are attached to the partitions 24*a* or to the shaft 25, and rotate therewith in the direction 102.

Due to the motion of the balls 40 in the direction 102, printing ink in the mixing compartments is moved generally in the direction 102 and passes after a certain angular travel the inlet 22 to the outlet 23. Due to the fact that the balls 40 move irregularly while orbiting in the direction 102, the different proportions of the various printing inks passing through inlet ends 51*b* into the respective mixing compartments 29 are effectively mixed together and produce in each mixing compartment a different mixed color corresponding to the mix proportion. In order to prevent the balls 40 from falling out through the slots 22 and 23, provision can be made whereby these are covered by a grid or perforated plate such that the printing inks can essentially pass through unhindered while the balls 40 are effectively retained inside the mixing chamber 201.

As shown in FIG. 2, the partitions 24*a* can also be designed in an open or in a blade-like fashion, thereby providing a certain degree of ink mixing between axially adjacent mixing compartments 29, the gaps in the partitions 24*a* being sufficiently small that the balls 40 located in the mixing compartments 29 cannot pass through the partitions 24*a*.

The balls 40 here can be composed of known abrasion-resistant or chemically inert material, for example, stainless steel, ceramic, or similar material, thereby preventing pieces or abraded material from the balls 40 from passing into the printing ink, or preventing any undesired chemical reactions from being triggered in the printing ink.

Figure 3:
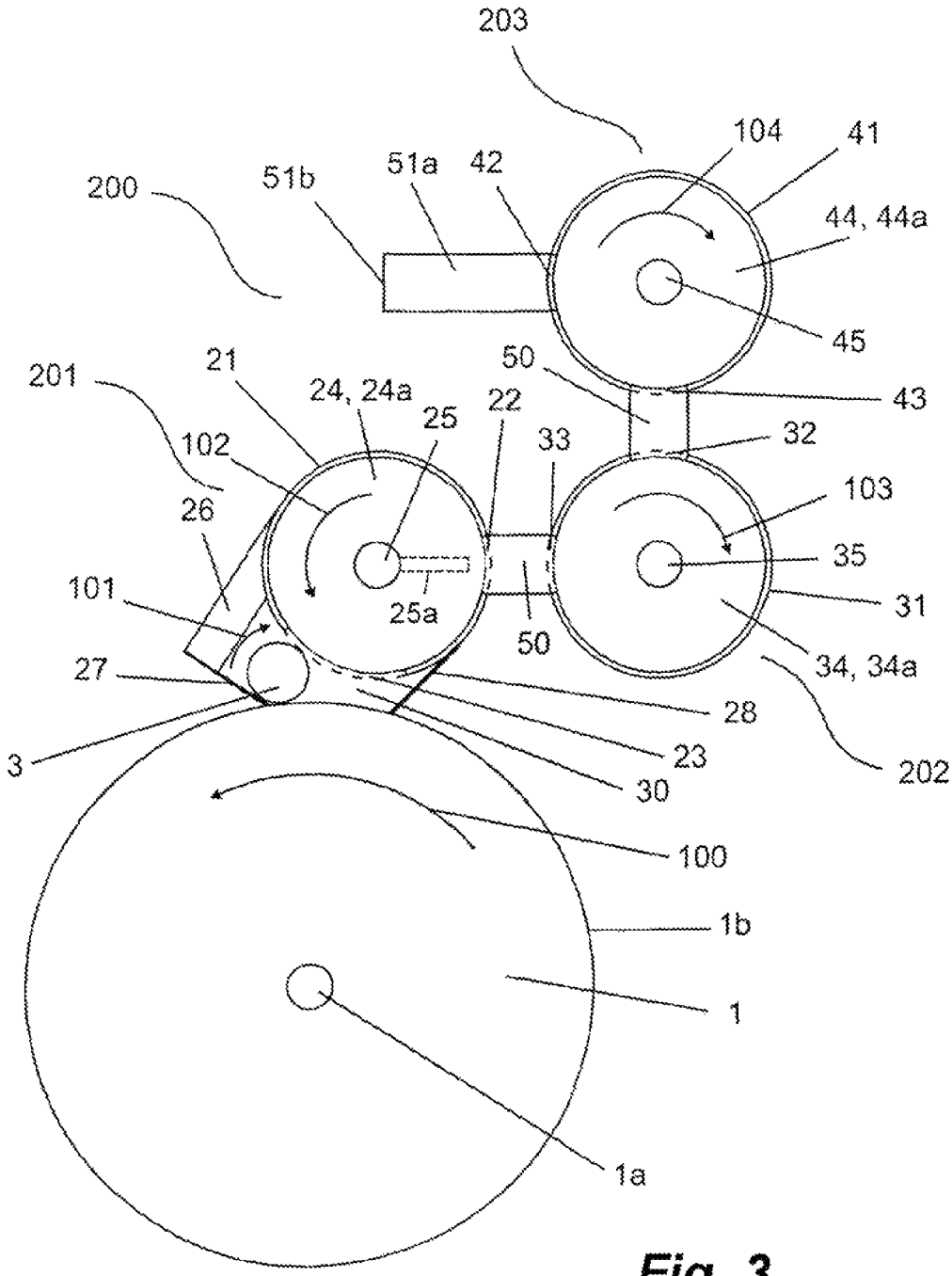
FIG. 3 is a schematic end view of a second embodiment of an inker according to the invention.

FIG. 3 is a schematic view of an inker 200 that comprises multiple individual mixing chambers 201, 202, 203 that are connected in series. Each of the above-mentioned mixing chambers 201, 202, 203 here operates on the principle described above so that different proportions of printing inks, or first or second mixed inks, are further mixed together in the respective mixing compartments 29, 39, 49.

Individual mixing chambers 201, 202, 203 are disposed here relative to each other such that the respective outlet ends 43, 33 are connected through respective connectors 50 to the associated inlets 32, 22. Provision can be made here whereby connectors 50 are divided into individual sections by partitions 50*a*, the number and arrangement of the subdivisions preferably corresponding to the number and arrangement of the mixing compartments of the upstream mixing chambers so as to prevent any uncontrolled and undesired mixing together of the first or second mixed inks after they emerge from each upstream mixing chamber.

Figure 4:
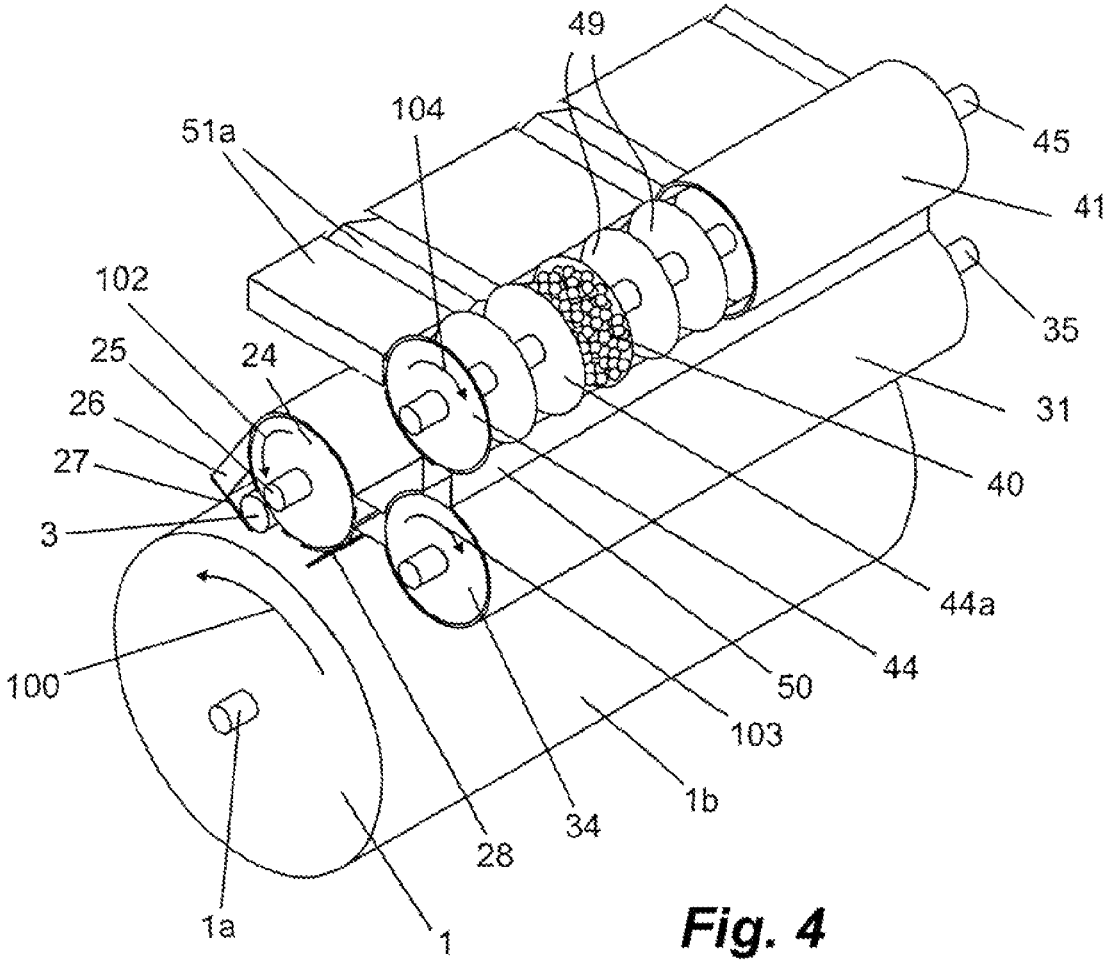
FIG. 4 is a schematic perspective view of an inker as indicated in FIG. 3.

FIG. 4 is a schematic perspective view of an inker according to the invention as indicated in FIG. 3, where the cylindrical outer surface 41 of the topmost mixing chamber 203 is shown cut away to show the inner design. As already described above, the respective mixing chambers 201, 202, 203 each have shafts 25, 35, 45, to which in each case a predetermined number of partitions 44*a* and covers 44 are attached. When a given shaft 25, 35, 45 rotates in the respective direction 102, 103, 104, partitions 24*a*, 34*a*, 44*a* are each entrained, and the balls 40 located in the respective mixing compartments 29, 39, 49 are similarly moved by unillustrated stirrers. As a result, the ink proportions that have passed into the respective mixing compartments are effectively mixed together, and the mixed ink is simultaneously transported from the respective inlets 22, 32, 42 to the respective outlets 23, 33, 43. The direction of rotation can be selected here such that the printing ink has the longest possible residence time within the given mixing compartment so as to achieve an optimum thorough mixing.

Figure 5:
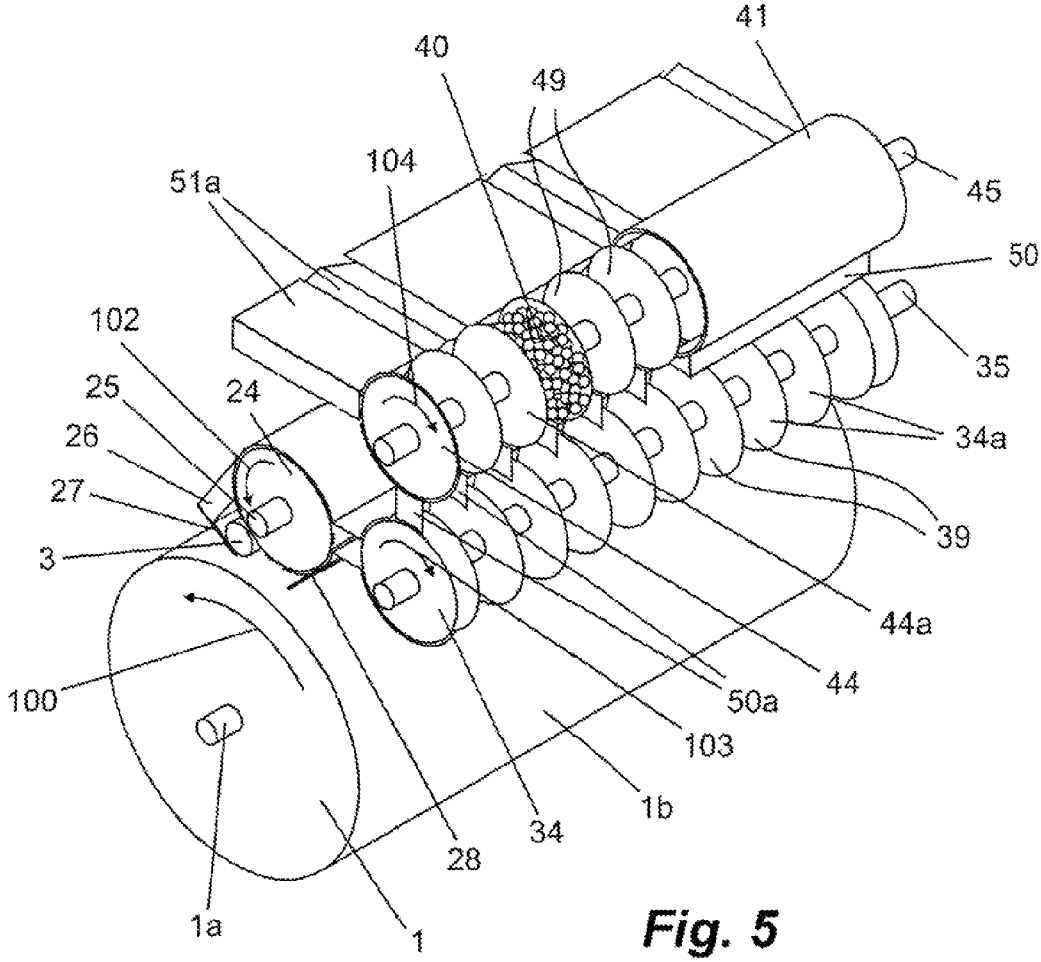
FIG. 5 is another schematic perspective view of an inker as indicated in FIG. 3.

FIG. 5 is another schematic view like FIG. 3, where the outer surface 31 of the mixing chamber 202 is also illustrated cut away to also show the inner design of the inking chamber. According to the invention, the mixing compartments 39, 49 are disposed relative to each other such that a first mixed ink passes from a first mixing chamber 203 through a connector 50 provided with partitions 50*a*, for example, proportionately into two adjacent mixing compartments 39 of the following mixing chamber, thereby enabling any residual color differences of first mixed inks to be further equalized.

Provision can furthermore be made whereby the number of mixing compartments of the following mixing chambers 202, 201, is selected to be higher than the number of mixing compartments of the previous mixing chamber, for example, double the number, thereby effecting, first of all, a continuously finer mixing together for adjacent mixed inks, and secondly, enabling at each point in time a controlled and homogeneous color gradient to be generated along the longitudinal axis of the rolling ink mass 3, and thus on the outer surface 1*b* of the ink-transfer roll 1.

Figure 6:
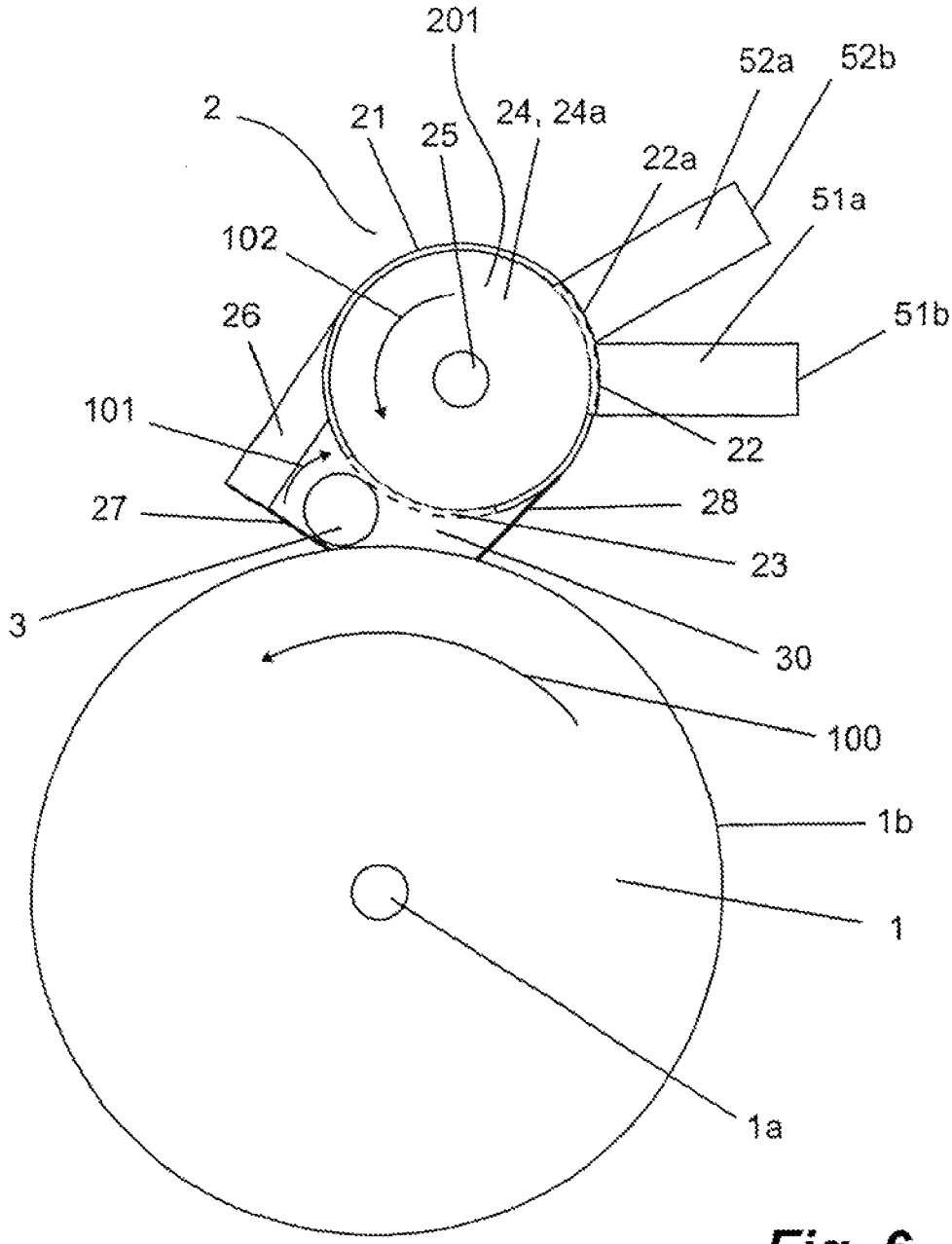
FIG. 6 is a schematic end view of a third embodiment of an inker according to the invention.

FIG. 6 shows a third embodiment of an inker according to the invention 2 with a mixing chamber 201, where the inker 2 in this embodiment has two inlets 22, 22*a*, through which in each case different printing inks can pass zonewise into mixing chamber 201. To this end, feed conduits 51*a*, 52*a* are attached to inlets 22, 22*a*, through which different printing inks are transported into inker 2, for example, respectively by pumps P from corresponding storage reservoirs.

As already described, the respective feed conduits 51*a*, 52*a* here can each have different cross-sectional shapes, and can also overlap each other along a common direction of extent parallel to the longitudinal axis of inking chamber 2 or to cylinder axis 1*a* of ink-transfer roll 1. The arrangement of additional feed conduits 52*a* that are disposed essentially parallel to first feed conduits 51*a* results in the ability to selectively introduce additional different printing inks into mixing chamber 201, and thus to readily generate additional mixed colors that otherwise could not be generated.

If, for example, the printing inks cyan, magenta, yellow are introduced through first side-by-side feed conduits 51*a* into the mixing chamber 201, transitional mixed colors can be generated between cyan and magenta, and between magenta and yellow—however not between cyan and yellow since these printing inks are not being introduced next to each other into the mixing chamber 201, that is into adjacent compartments. If, conversely, the printing inks are selectively introduced in the sequence magenta, yellow, cyan through a parallel feed line 52*a* into the mixing chamber 201, it is possible alternatively to generate the transitional mixed colors between magenta and yellow, and between yellow and cyan.

If in each case different ink supplies of feed lines 51*a* and 52*b* are combined by an approach in which printing inks are in each case introduced through these lines into the mixing chamber 201, it is also possible to selectively generate additional mixed colors even with the printing machine in operation, including by an approach in which, for example, mixing chamber 201 is filled with different printing inks simultaneously through feed lines 51*a*, 52*a* that are parallel to or overlap each other.

It is of course obvious that the number of respective feed lines 51*a*, 52*a*, and the cross-sectional shapes 51*b*, 52*b* of the feed lines 51*a*, 52*a*, as well as their mutual arrangement and arrangement relative to each other, can be the same or different depending on requirements.

In regard to all of the embodiments, it must be pointed out that the technical features mentioned above in connection with one embodiment can be employed not only for the specific embodiment, but also for the other embodiments. All of the disclosed technical features of this invention must be classified as essential to the invention and are usable in any desired combination or alone.

We claim:

1. An inker for applying ink to a transfer roll of a printing machine, the inker comprising:

an inking chamber extending longitudinally along the transfer roll and having an outlet also extending longitudinally along the transfer roll and open against the transfer roll;

a first generally cylindrical mixing chamber centered on an axis, spaced transversely from and extending longitudinally along the transfer roll;

a rotatable shaft extending along the axis in the first mixing chamber and carrying a partition subdividing the mixing chamber into two axially adjacent and axially spaced first mixing compartments open radially into the inking chamber;

two inlet conduits opening into each of the first mixing compartments; and pump means for feeding respective different inks to the inlet conduits and therethrough into the mixing compartments such that each of the first mixing compartments receives inks from the respective inlet conduits.

2. The inker defined in claim 1 wherein the first mixing chamber has an ink outlet that extends parallel to the outlet of the inking chamber and that is supplied by ink from all of the mixing compartments.

3. The inker defined in claim 1 wherein the first mixing chamber has an ink inlet that extends parallel to the outlet of the inking chamber and that is connected to all of the inlet conduits.

4. The inker defined in claim 1, further comprising, between the first mixing chamber and the inking chamber, a second mixing chamber and having a second such shaft and partition defining two second mixing compartments connected to the first mixing compartments, whereby inks supplied by the conduits to the first mixing compartments are mixed again in the second mixing compartments before entering the inking chamber.

5. The inker defined in claim 1 wherein the inlet conduits have downstream ends opening into the first mixing compartments and of axially elongated and varying widths.

6. The inker defined in claim 5 wherein the downstream ends overlap axially, whereby ink from each conduit can enter more than one of the mixing compartments.

7. The inker defined in claim 1, further comprising loose mixing elements in each of the first mixing compartments; and stirrers rotationally fixed to the shafts for agitating the loose mixing elements in the respective compartments on rotation of the respective shafts.

8. A method of applying ink to a transfer roll of a printing machine having an inking chamber extending longitudinally along the transfer roll and having an outlet also extending longitudinally along the transfer roll and open against the transfer roll;

a first generally cylindrical mixing chamber centered on an axis and spaced transversely from and extending longitudinally along the transfer roll; and two axially spaced generally circular partitions in the first mixing chamber subdividing same into a plurality of axially spaced first mixing compartments, the method comprising the steps of:

simultaneously feeding respective but different inks into each of the first mixing compartments; and rotating the generally circular partitions about the axis so as to mix the respective inks in the first mixing compartments and to feed the mixed inks from the first mixing compartments into the inking chamber for application to the transfer roll.

9. The method defined in claim 8 wherein the ink-transfer roll is rotated so as to form ink in the inking chamber into a longitudinally extending rolling mass contacting an outer surface of the transfer roll and formed of the different inks mixed together along its axial length.

10. The method defined in claim 8 further comprising the steps of:

providing a second mixing chamber adjacent the first mixing chamber and subdividing it by two rotating partitions into a plurality of second mixing compartments; and feeding the inks into the second mixing compartments and thence into respective ones of the first mixing compartments of the first chamber.

11. The method defined in claim 8 wherein the first mixing compartments are all maintained with a unique proportion of two different inks.

12. The method defined in claim 8 wherein each ink is fed into two adjacent first mixing compartments to both axial sides of the partition subdividing them from each other.

13. The method defined in claim 12 wherein the inks are fed into adjacent first mixing compartments by forming outlet ends of inlet conduits such that they extend across the respective partitions.

14. The method defined in claim 8 wherein each of the partitions is formed with axially open gaps permitting some flow of ink axially between the first mixing compartments.

15. The method defined in claim 8, further comprising the steps of:

providing loose mixing elements in the first mixing compartments and agitating the loose mixing elements to mix the inks by rotation of the generally circular partitions.

16. The method defined in claim 8, further comprising the steps of:

pouring the inks as a curtain from outlets of the first mixing compartments into the inking chamber; and rotating the ink-transfer roll such that the curtain is formed into an axially extending rolling mass of inks on the outer surface of the ink-transfer roll.

* * * * *